United States Patent [19]

Weder et al.

[11] 4,199,627

[45] Apr. 22, 1980

[54] DECORATIVE GRASS

[75] Inventors: Erwin H. Weder, Highland, Ill.; Donald E. Weder, Hobart, Okla.

[73] Assignee: Highland Manufacturing & Sales Co., Highland, Ill.

[21] Appl. No.: 593,446

[22] Filed: Jul. 7, 1975

[51] Int. Cl.[2] ..... A41G 1/00

[52] U.S. Cl. ..... 428/7; 264/151; 264/288.8; 428/17; 428/222; 428/401; 428/921

[58] Field of Search ..... 428/17, 7, 5, 222, 409, 428/910, 920, 921, 922, 401; 264/210 R, 148, 151

[56] References Cited

U.S. PATENT DOCUMENTS

| | | | |
|---|---|---|---|
| 2,016,334 | 10/1935 | McComb | 428/7 |
| 2,336,100 | 12/1943 | Jacque | 57/167 |
| 2,399,744 | 5/1946 | Kaphan | 428/222 X |
| 2,815,439 | 12/1957 | Plubell | 428/14 X |
| 3,416,991 | 12/1968 | Yoshimura | 428/332 X |
| 3,459,845 | 8/1969 | Hebeler | 264/151 X |
| 3,558,580 | 1/1971 | Orser | 264/210 R X |
| 3,650,877 | 3/1972 | Johnson | 428/222 |
| 3,673,056 | 6/1972 | Nadler | 428/17 |
| 3,803,284 | 4/1974 | Burghardt et al. | 264/151 X |
| 3,869,533 | 3/1975 | Janocha et al. | 264/147 X |
| 3,933,959 | 1/1976 | Skochdopole et al. | 264/151 X |

*Primary Examiner*—Henry F. Epstein

*Attorney, Agent, or Firm*—Clarence A. O'Brien; Harvey B. Jacobson

[57] ABSTRACT

A decorative grass or grass-like product in the form of strips of plastic material of predetermined dimensional characteristics having color, anti-static agents and flame retardants incorporated therein prior to extrusion of the resin thereby preventing rub off of the color, minimizing clinging of grass to the hands and clothes of a decorator, thus facilitating handling of the grass, and assuring that the grass will consistently exceed the flammability requirements of the Federal Hazardous Substances Act Regulations in order to be labeled "non-flammable". Processes for making the grass include an extruder for plastic material and including a film extrusion die or a strand extrusion die. When a film is extruded, the film is cooled and slit longitudinally into strips of predetermined width. In another process, the extruded strips or strands are cooled. In all processes, the plastic strips pass through a slow godet, a drawing oven and a high speed godet to enable the strips or strands to be drawn down in width and thickness without breaking. From the high speed godet, the strips or strands are chopped to a desired length and conveyed to a storage area.

3 Claims, 7 Drawing Figures

42

10
12
14
16
18
20
22
24
26
27
28
30
32
34
36
38
40
42

DECORATIVE GRASS

BACKGROUND OF THE INVENTION

1. Field of the Invention

The present invention generally relates to decorative grass and a process of making such grass with the process including three embodiments with the plastic material, such as polypropylene, from which the grass is constructed being clear or provided with a colorant, anti-static agent and flame retardant material which is mixed into the resin prior to extrusion of the resin through a film forming die in two of the embodiments of the invention and a strip forming die in the third embodiment of the invention.

2. Description of the Prior Art

Decorative grass has been used for many years in filling Easter baskets and other decorative purposes. Such grass involved the use of scrap plastic material, paper, cellophane, or the like, which is shredded by the use of rotary knives. Previously known processes involved the addition of color to the shredded grass by coating the film with a colorant prior to shredding. However, this colorant often rubs off onto the hands and clothes of a person handling the grass and also frequently washes off when water comes into contact therewith. Previous techniques employed the addition of flame retardants to the surface of the grass but the flame resistance is quite highly variable and often fails to meet the requirements of the Federal Hazardous Substances Act and little or no static control is provided. When shredding paper-type material into decorative grasses, considerable dust and chaff results from the drying and flaking off of flame retardant agents and from irregularities inherent in a shredding process. In view of existent problems with conventional, well-known decorative grasses constructed from paper, cellophane, and shredded plastic, the use of such grass has been more or less restricted to use with Easter baskets and associated uses for the grass such as when it is used to form a "nest" for candy eggs and other related uses.

SUMMARY OF THE INVENTION

An object of the present invention is to provide a decorative grass of plastic material extruded from a resin in which a color, flame retardant and anti-static agent are incorporated prior to extrusion.

Another object of the invention is to provide a decorative grass in which plastic strips are annealed and stretched to reduce the thickness and width of the strips to provide desired predetermined dimensions and shape characteristics to the strips prior to the strips being chopped into predetermined length depending upon the requirements of individual uses.

A further object of the invention is to provide a decorative grass and process for making the grass which can be effectively employed for packing Easter baskets, candy boxes, and also used to prepare decorative floral arrangements for all seasons of the year, to safely and decoratively package gifts, prepare window displays, make Christmas wreaths, and for many other decorative uses in which such uses are facilitated by the decorative grass of this invention having a greater bulk per unit weight than presently available decorative grasses constructed of paper, cellophane, or plastic, which has been shredded by rotatable knives.

Still another important object of the present invention is to provide decorative grass and a process for making same in which the plastic resin is extruded either in the form of a film or a plurality of narrow strips with the extruded plastic being cooled and, if in film form, being slit into strips after which the strips pass through an annealing and drawing oven having a slow godet at the entrance end and a faster godet at the exit end for stretching or elongating the strips to reduce their thickness and width, after which the stretched or elongated strips are chopped to a desired length and conveyed to a storage area.

A still further object of the invention is to provide a decorative grass in accordance with the preceding objects having many additional uses because of its particular construction and the process by which it is constructed with the grass and variations in the process for making the same enabling economical manufacture of the decorative grass which avoids or corrects present day problems encountered in the use of commercially available decorative grass.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figures 1A, 1B, 4:
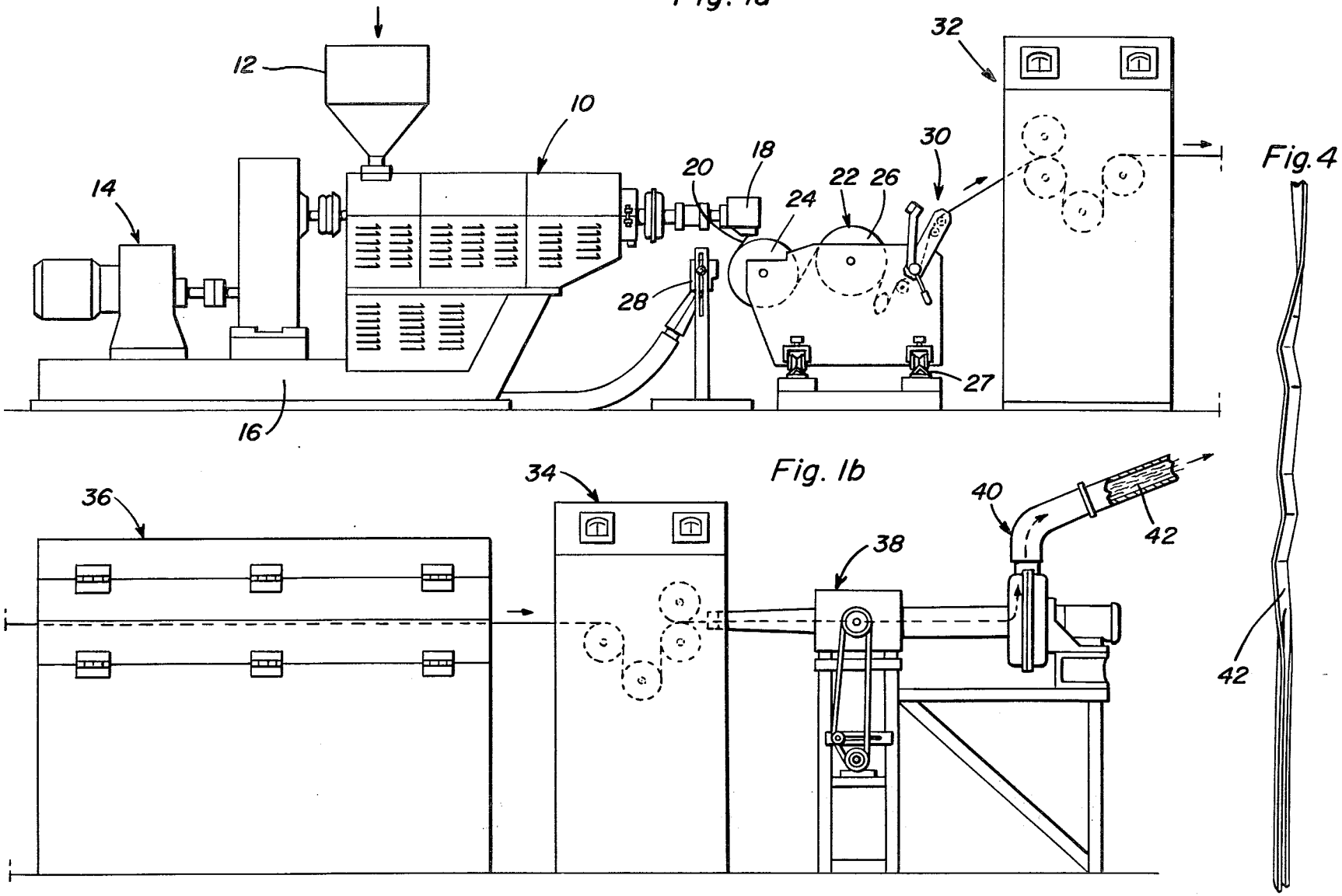
FIGS. 1*a* and 1*b* is a schematic side elevational view of the apparatus used in one process of making decorative grass.
FIG. 4 is a perspective view of a segment of one of the strips of grass constructed in accordance with this invention.

Referring now specifically to the drawings, FIGS. 1*a* and 1*b* illustrate schematically the apparatus employed in carrying out the first process for constructing decorative grass and includes an extruder 10 with the hopper 12 thereon driven by a suitable drive mechanism 14 supported on a base 16 or the like which is of conventional structure and includes a film extrusion die 18 for discharging a plastic film 20 in a conventional and well-known manner. The film 20 then passes through a double chill roll stand 22 which includes a pair of chill rollers 24 and 26 through which chilled water passes. The particular construction of the extruder, extrusion die 18 and air knife 28 associated therewith are of conventional construction and form no particular part of the present invention.

The plastic film after passing through the double roll chiller 22 passes through a slitter 30 in the form of spaced stationary knives which slit or cut the film into strips or strands of desired width. The slitted web in the form of a plurality of side-by-side strips then enters a godet 32 which is operated at a relatively slow speed as compared to a second godet 34 spaced therefrom. In between the godets 32 and 34 is an annealing and drawing oven 36 which softens the plastic strips by heating the same in order to facilitate draw down of the width and thickness of the strips or strands. The plastic strips which exit from the high speed godet enter a chopper unit 38 where the strips are chopped into predetermined length and from the chopper, the chopped strips enter and are conveyed by a conveyor unit 40 in the form of a centrifugal blower which conveys the chopped strips 42 to a storage area (not shown) which may be in the form of a suitable bin, packaging machine, or the like.

In addition to the apparatus illustrated schematically in FIGS. 1*a* and 1*b*, a resin blender of conventional construction will be provided to blend resins, colorants, anti-static agents and flame retardants into a homogenous mixture and discharge the same into the feed hopper 12 of the extruder 10. Also, a heat exchanging device will be provided for cooling the water and maintaining it at 70° F. plus or minus 2° F. for maintaining the double chill rolls at a predetermined temperature. Also, a scrap grinder to regrind scrap plastic for recycling can be provided.

In using the apparatus disclosed in FIGS. 1*a* and 1*b*, the blended resins and additives are introduced into the extruder feed hopper and the extruder is brought to proper operating temperatures with these temperatures varying for different resins and different blends of resins. For example, in a five barrel zone extruder, a good starting temperature would be, zone 1, 300° F., zone 2, 350° F., zone 3, 400° F., zone 4, 450° F., and zone 5, 450° F. with the die extruder also being 450° F. After the extruder has reached proper temperature, it should be allowed to "soak" at this temperature for 30 minutes and the feed screw can then be started slowly and gradually brought up to full speed with the screw being allowed to run at full speed for about two minutes and then stopped and the die lips should be properly cleaned.

The water chiller and circulator (not shown) should be started to circulate water through the chill rolls 24 and 26 with the temperature of the water being set and retained at 70° F. with temperature adjustment being provided, if necessary, to obtain desired clarity and strength. The chill roll stand should now be moved under the die by lateral movement along supporting tracks and roller assemblies 27 and the rolls 24 and 26 started to rotate. The extruding screw should then be started at about half speed and gradually brought up to operating speed with the chill roll speed and the die lip settings being adjusted to obtain a film thickness that is desired. The initial thickness should be approximately 3.5 times the desired finished thickness. Thus, if a finished film with a thickness of 1 mil is desired, the initial thickness of the web or film should be 3.5 mils.

The knives in the slitter 30 should be spaced to cut strips of the proper width. The initial slit width should be about 2.5 times the desired finished width. Thus, if a finished strip with a width of 50 mils is desired, the initial width of the strip should be 125 mils. The slitted web or film is threaded through the first godet 32 with the speed of the first godet being adjusted to maintain a small amount of tension between the chill rolls and the first godet. The temperature of the oven 36 should be set at the proper level to permit the strips to be drawn down in width and thickness without breaking, but not so hot as to cause the strips to become sticky. A good initial temperature for the oven is 300° F. and when reaching this temperature, the plastic film should be threaded through the oven. After the web or film has been threaded through the oven 36, the knives in the slitter 30 should be lowered into the web or film. Then, the high speed godet should be started and the speed should be set at about 5 times the speed of the low speed godet. The web or film should be threaded through the high speed godet and into the chopper unit 38 with the chopper speed being adjusted to obtain grass of a desired length. The process is thus operating at full speed with it being necessary to continually monitor temperature and speed settings and to rethread any strips which may break. This type of process may be termed a dry process inasmuch as the web or plastic film is cooled while engaging the external surface of a single chill roller or double chill roller with the cooling water being circulated through the chill roller or rollers in a conventional and well understood manner. The godets, slitter, oven, and conveyor are all conventional components with the chopper being our original design and generally being in the form of a reel type mower in which only a single blade is provided on the reel.

Various types of plastics may be used but the primary component of the decorative grass is polypropylene. To avoid excessive stiffness, either low density polyethylene or ethylene-vinyl-acetate can be added. Various proportions of polypropylene to the additives are used to provide a finished grass tailored to individual requirements of each use of the grass. Low density polyethylene and ethylene-vinyl-acetate can be used interchangeably to reduce the stiffness of the polypropylene although a smaller proportion of ethylene-vinyl-acetate will reflect the same amount of reduction in stiffness as a larger proportion of low density polyethylene. Usually, about 1.5 parts low density polyethylene to 8.5 parts polypropylene or 1 part ethylene-vinyl-acetate with 30% vinyl acetate content to 9 parts polypropylene will provide the required "hand" for the finished grass. Different grades of polypropylene, polyethylene and ethylene-vinyl-acetate require blending different proportions of the resins to achieve the desired "hand" to meet the needs of different consumers or customers.

Various types of commercially available coloring agents can be used to achieve the desired color. Such coloring agents which have been successfully employed include dry powder-type colorants, liquid colorants, color concentrates and pelletized colorants. Also, various flame retardants can be used. Successful use has been made of flame retardants obtained from various commercial outlets such as Dow Chemical Company, Monsanto Chemical Company, and several others. Various effective commercially available anti-static agents have been found with one such supplier of such agents being Armak Chemical Company. The proportions of colorants, flame retardants and anti-static agents used are relatively small with these proportions being adjusted after test runs are made with each variety of material.

Decorative grass made in accordance with the process and apparatus schematically illustrated in FIGS. 1*a* and 1*b* are in the form of individual strips or strands having a width of from approximately 0.020 inches through 0.1250 inches, a thickness from approximately 0.0005 inches through 0.0030 inches and a length of approximately 2 inches through 24 inches with the width, thickness and length being adjusted as required to meet the requirements of individual consumers. The decorative grass can be produced clear or in almost any color required and the colors can be transparent or opaque including but not exclusively red, green, yellow, pink, orchid and blue. Also, the individual grass strips 42 produced by the process tend to curl somewhat in the transverse direction forming small tubes or semitubes and the decorative grass also tends to curl longitudinally, thus contributing to the greater bulk per pound than presently available decorative grass products.

Figure 2A:
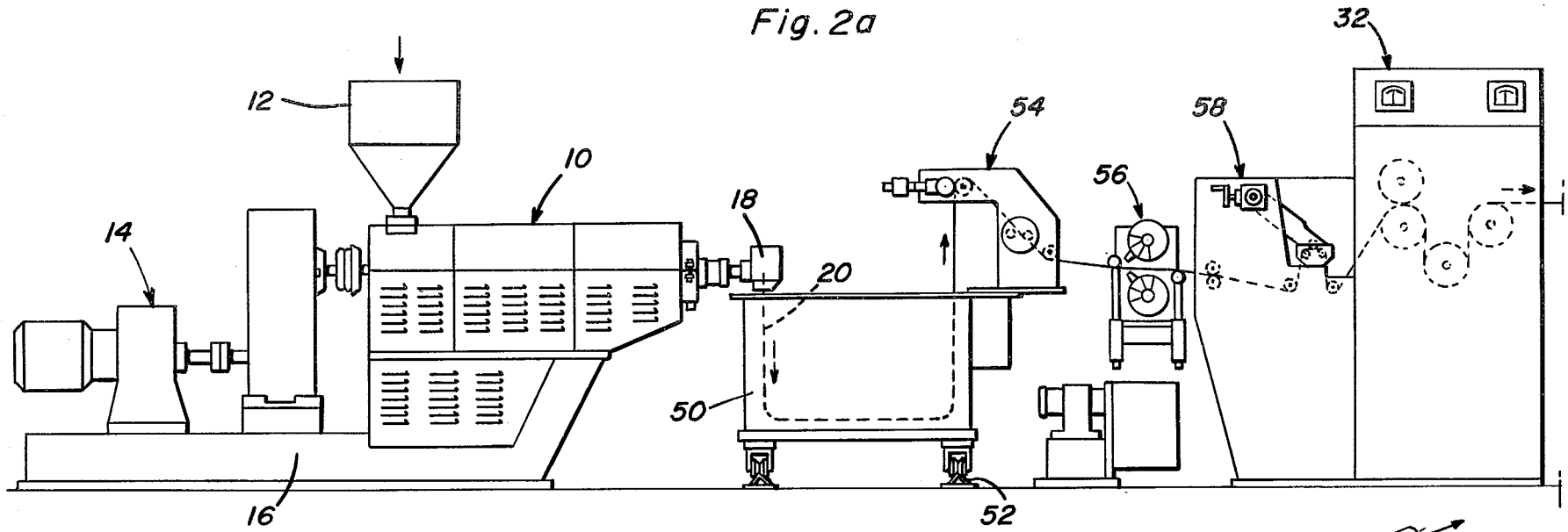
FIGS. 2*a* and 2*b* is a schematic side elevational view illustrating a second embodiment of the apparatus and process for making decorative grass.
Figure 2B:
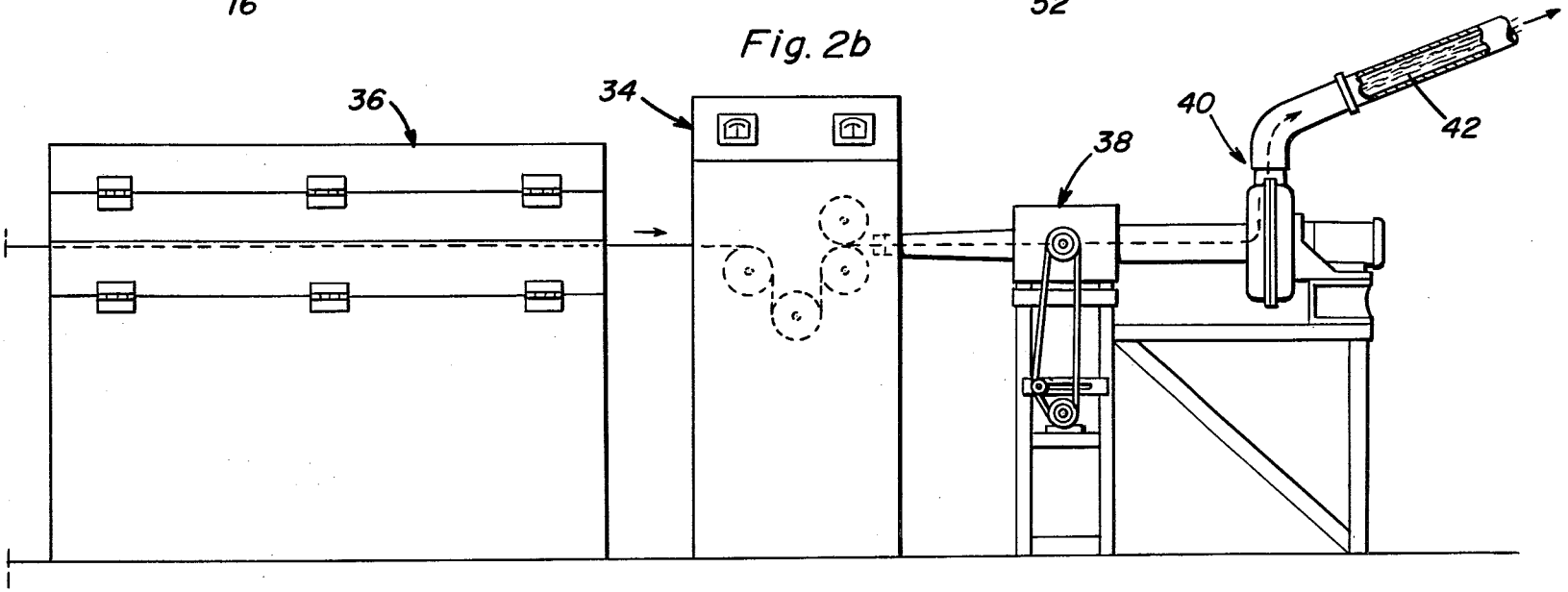

FIGS. 2*a* and 2*b* illustrate a second embodiment of the apparatus and method in which the extruder 10 and film extrusion die 18 remain the same as does the first godet 32, the second godet 34, the annealing and drawing over 36, the chopper unit 38, the conveyor blower 40 and the pipe for discharging the grass 42 with the changes residing in the cooling and slitting of the film.

In this embodiment, a water containing quench tank 50 is provided which receives the film 20 as it is discharged from the extrusion die. The tank 50 is supported on rails 52 extending transversely of the extrusion die and is provided with temperature controls and water circulating means for maintaining a predetermined quantity of water in the tank at a predetermined temperature. The film 20 is immersed in the water and extends downwardly into the tank at one side thereof generally in alignment with the extrusion die 18 and emerges vertically therefrom at the other side of the tank where it passes through a hydro stripper generally designated by numeral 54, in the form of rollers to wipe or remove excess water from the film with such water being deposited back into the tank. From the hydro stripper 54, the film 20 then extends into a vacuum wiper generally designated by numeral 56 in which vacuum nozzles positioned adjacent opposide sides of the film will remove any remaining water or moisture therefrom. After the film has been vacuum wiped, it passes through a slitter with stationary knives which are the same type as employed in the first embodiment for slitting the film into a plurality of strips or strands with the film being threaded through the low speed godet, oven, high speed godet and into the chopper unit, all of which are adjusted to provide the desired thickness of strips and desired width and length of strips. The quench tank is communicated with a water chiller on a cooling tower or a fresh water supply in order to maintain the quench bath at the proper temperature. The oven, as in embodiment No. 1, may employ hot air, hot rolls, hot liquids, any suitable hot surface or infra-red heat to soften the plastic strips to facilitate draw down of the width and thickness of the strips or strands. Also, the high speed godet should be adjusted to operate at about 5 times the speed of the low speed godet and the chopper-conveyor unit should be set to produce the required length of grass 42. The starting operation and procedure employed in this embodiment of the invention, other than the cooling and slitting stage remains the same as embodiment No. 1. The grass produced by this process is flat and softer than grass produced by process No. 1 since the water bath cools the material evenly on both sides while the chill rolls cool one side more than the other thus contributing to greater curl in the grass formed by process No. 1. A high yield per pound is maintained by drawing the strands of grass down to a thinner strip therefore yielding more square inches per pound and greater bulk.

Figures 3A, 3B:
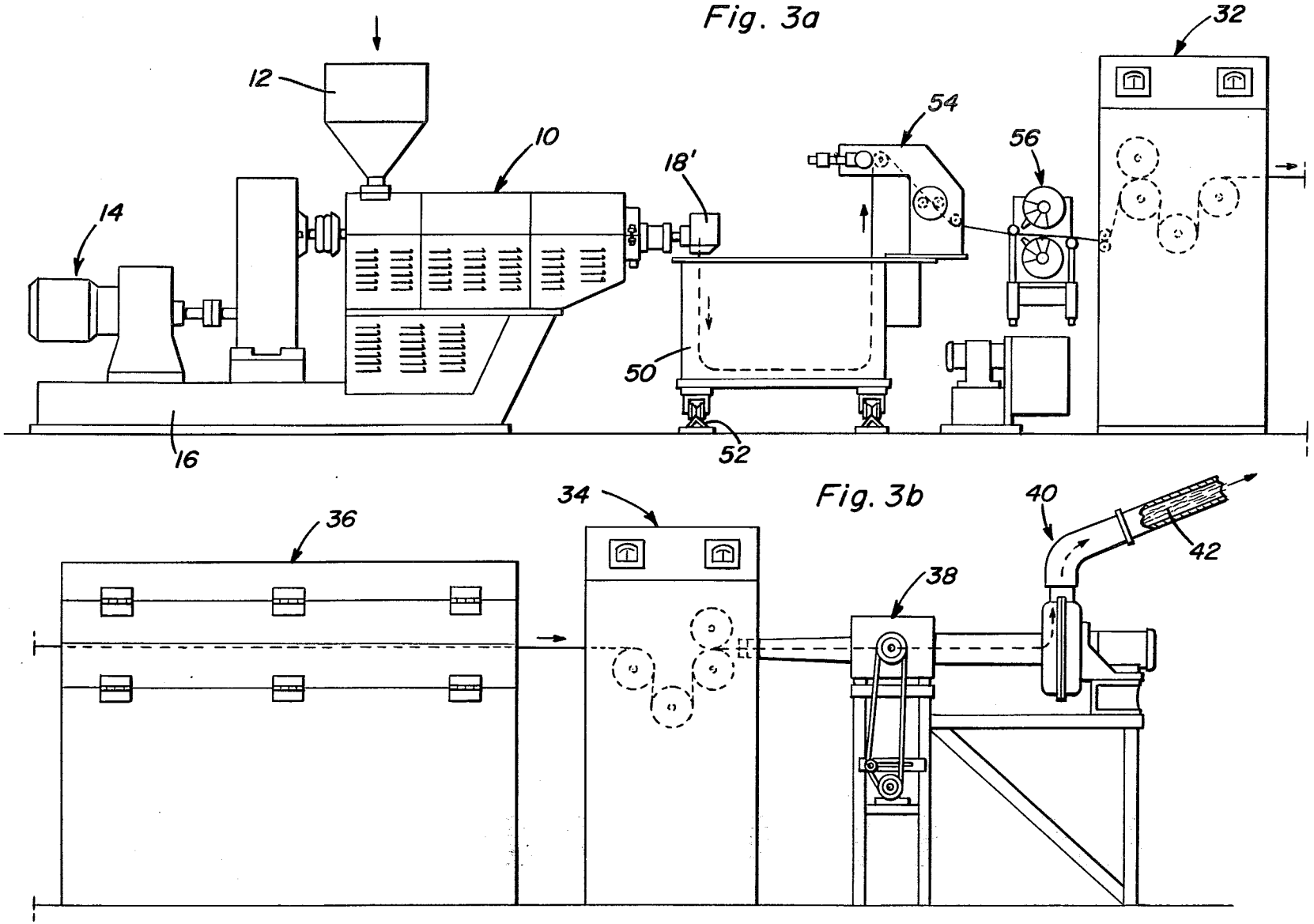
FIGS. 3*a* and 3*b* is a schematic side elevational view of a third embodiment of the process and apparatus.

FIGS. 3*a* and 3*b* disclose a third embodiment of the invention which is identical to the embodiment illustrated in FIGS. 2*a* and 2*b* with the exception that the slitter 58 has been eliminated and the extrusion die 18' is the type of die which will extrude film strips or strands of a predetermined width and thickness. Thus, the plastic material is extruded from the extrusion die 18' in the form of a plurality of side-by-side strips or strands which are cooled in the quench tank 50 and then pass through the hydro stripper 54 and the vacuum wiper 56. Since the strands do not need to be slit, the strands or strips then proceed directly through the low speed godet 32, the oven 36, the high speed godet 34, the chopper 38 and conveyor unit 40. The manner of operation of the extruder, quench tank, stripper, dryer, and the other structure disclosed in FIGS. 3*a* and 3*a* is the same as the operation of the apparatus disclosed in FIGS. 2*a* and 2*b*. Grass produced by this process is almost identical to that produced by process No. 2.

The decorative grass produced by each of the processes and apparatuses disclosed in the drawings has color, anti-static agents and flame retardants cast into the plastic prior to extrusion of the plastic into a film or strips or strands. The incorporation of the colorant into the plastic prior to extrusion prevents rub off of color on the hands and clothes and permits the use of the decorative grass in application where it comes into contact with water as in floral arrangements, wreaths, and the like. The incorporation of the anti-static agents into the plastic minimizes clinging of the grass to decorator's hands and clothes and facilitates working of the grass into desired arrangements. The incorporation of flame retardants into the plastic insures that the decorative grass will consistently exceed the flammability requirements of the Hazards Substances Act in order to be labeled "non-flammable". Therefore, the grass resulting from the processes and apparatuses disclosed completely eliminate the problem of presently available decorative grasses which have been coated on the exterior with a colorant and subsequently shredded which results in the colorant frequently rubbing off or washing off. Also, the present grass avoids the existing problem of flame resistance of conventional grasses being highly variable and often failing to meet the requirements of the Hazards Substances Act for labeling as "non-flammable". Moreover, conventional decorative grasses have little or no static control which renders them rather difficult to handle especially under conditions which result in substantial static electricity being generated due to movement of the decorator's hands and the like. Also, the process disclosed eliminates substantially all of the dust and chaff which are produced when conventional paper-type grasses are shredded which results from the drying and flaking off of flame proofing agents and from irregularities inherent in the shredding process which employs rotary knives. Also, the present grass and processes has a greater yield than conventional grass-like products, that is, the decorative grass of this invention provides greater bulk per pound than any of the other known grass products. For example, one pound of the grass resulting from the present invention is equivalent in bulk to about 1.8 pounds of most paper and cellophane grasses and to about 1.5 pounds of shredded plastic grasses.

In actual tests conducted in accordance with procedures prescribed by the Hazards Substances Act (16 CFR 1500.44), it was determined that the material would not propagate a flame and would actually melt and drip in the presence of a flame and was self-extinguishing when the flame was removed. Even in the presence of a flame, the "burning" or deterioration of the grass was approximately 0.05 inches per second. Also, during tests for color transfer, no transfer of color onto paper or wood was experienced when dry, wet with water or oily with lanolin. In this test, a sample of grass was moved over a clean surface 100 times while pressing the sample to the surface with a pressure of 4 pounds per square inch, in which a "rubbing stroke" consisted of a traverse, back and forth, of a 4 inch track. Surfaces tested included white typewriter paper, regular white bond paper and a smooth untreated pine board. Samples were tested dry, moist with water and oily with lanolin and 5 stroke tests were also performed on human skin with no color transfer being observed in any tests. Numerous samples were tested with the color fastness and resistance to flammability being consistent in all of the samples tested.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Decorative grass for use in filling Easter baskets, candy boxes, preparing floral arrangements, wreaths and other decorative purposes comprising a lightweight mass of randomly arranged flexible, thin, extruded, thermoplastic plastic film strips intertwined into a cohesive mass, said strips having substantially the same length, width and thickness and including flat portions, random longitudinal curls and random transverse curls for increasing the volume of the mass without increasing the weight, said curls being defined by strips stretched lengthwise by moving one end approximately five times as far as the other end while heated thereby decreasing the width and thickness of the strips.

2. The decorative grass as defined in claim 1 wherein said plastic strips include a colorant, flame retardant and anti-static agent incorporated therein prior to extrusion and curing of the resin thereby providing a stable plastic strip.

3. A product having a grass-like appearance comprising a plurality of flexible, extruded thermoplastic strips, said strips being in the form of plastic film strips having substantially the same length, width and thickness, each of said plastic film strips including flat portions, random longitudinal curls and random transverse curls, each film strip having a thickness of approximately 1 mil and a width of approximately 50 mils, said plastic film strips being loosely intertwined into a lightweight cohesive mass for use as decorative grass.

* * * * *